US005428948A

United States Patent [19]

Ballhausen et al.

[11] Patent Number: 5,428,948

[45] Date of Patent: Jul. 4, 1995

[54] SPINDLE FOR MANUFACTURING YARN WITH INLET LINE FOR INTRODUCING FLOWABLE MEDIUM INTO THE FIBER BALLOON

[75] Inventors: Ulrich Ballhausen, Aachen; Rainer Lorenz, Nettetal-Breyell; Ulrich Lossa, Krefeld; Karl J. Brockmanns, Willich-Anrath, all of Germany

[73] Assignee: Palitex Project-Company GmbH, Krefeld, Germany

[21] Appl. No.: 208,965

[22] Filed: Mar. 9, 1994

[30] Foreign Application Priority Data

Mar. 9, 1993 [DE] Germany ..... 43 07 296.8

[51] Int. Cl.[6] ..... D01H 13/30; D02G 3/36

[52] U.S. Cl. ..... 57/296; 57/58.49; 57/58.83; 57/308; 57/352; 57/354

[58] Field of Search ..... 57/295, 296, 308, 58.36, 57/58.38, 58.49, 58.83, 352, 354

[56] References Cited

U.S. PATENT DOCUMENTS

| | | | |
|---|---|---|---|
| 3,295,306 | 1/1967 | Rehn | 57/296 |
| 4,023,337 | 5/1977 | Speranzin | 57/296 |
| 4,040,241 | 8/1977 | Speranzin | 57/296 |
| 4,051,651 | 10/1977 | Wahlen et al. | 57/296 |
| 4,114,357 | 9/1978 | Greive | 57/296 |

FOREIGN PATENT DOCUMENTS

| | | | |
|---|---|---|---|
| 1760063 | 12/1971 | Germany . | |
| 2627268 | 12/1977 | Germany . | |
| 2811583 | 2/1979 | Germany | 57/308 |
| 3721364 | 2/1990 | Germany . | |

*Primary Examiner*—Daniel P. Stodola
*Assistant Examiner*—William Stryjewski
*Attorney, Agent, or Firm*—Robert W. Becker & Associates

[57] ABSTRACT

A spindle for manufacturing yarns has a spindle rotor with a central axis. A fiber guide duct extends substantially from the central axis radially outwardly for guiding a first fiber radially outwardly. The first fiber, after exiting the fiber guide duct, is guided under formation of a fiber balloon to a centering point that is located on an extension of the central axis of the spindle rotor. At least one inlet line that extends substantially radially toward the fiber balloon is provided for introducing a flowable medium into a space limited by the fiber balloon.

10 Claims, 5 Drawing Sheets

SPINDLE FOR MANUFACTURING YARN WITH INLET LINE FOR INTRODUCING FLOWABLE MEDIUM INTO THE FIBER BALLOON

BACKGROUND IF THE INVENTION

The present invention relates to a spindle for manufacturing yarn. The spindle has a spindle rotor with a fiber guide duct extending substantially from an area of the central axis radially outwardly for guiding a fiber radially outwardly. The fiber, after exiting from the fiber guide duct is guided under formation of a fiber balloon to a centering point that is located on an extension of the central axis of the spindle rotor.

With such spindles in which the fiber or yarn exiting from the radially extending fiber guide duct is guided under ballooning to a centering point at the extension of the spindle rotor axis, the fiber balloon substantially presents an obstacle to the introduction of a flowable medium, for example, a treatment medium, into the space which is limited by the fiber balloon.

The flowable medium may, for example, be conditioned air or a two-phase medium such as air and suspended droplets of a suitable liquid, suspended solid particles or dissolved fiber material. Such media are designed to provide special effects on the yarn, respectively, the thread.

From German Patent 37 21 364 a spindle rotor as a part of a device for manufacturing a yarn or thread is described. A flowable medium is introduced into the space limited by the fiber balloon through the spindle rotor. For this purpose, the spindle rotor is provided with a plurality of spoke-like arranged guide plates whereby the fiber guide channel extends through one of these guide plates. The flowable medium is substantially guided from the exterior inwardly parallel to the spindle rotor axis, and the feed devices must be arranged in a relatively tight space before the spindle rotor which is also needed for other device components. Also, the feed lines must be arranged in this area. Furthermore, the guide plates of the spindle rotor have proven to be an obstacle for the free flow especially of solid particles, and, in addition, surrounding air is guided through the spindle rotor due to the ventilation effect which results in soiling of the guide plates causing further undesirable effects with respect to the introduction of the medium.

It is an object of the present invention to provide a spindle of the aforementioned kind with which a flowable medium can be introduced without interference into the space limited by the fiber balloon without requiring the arrangement of necessary components in the tight space axially before the spindle rotor.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
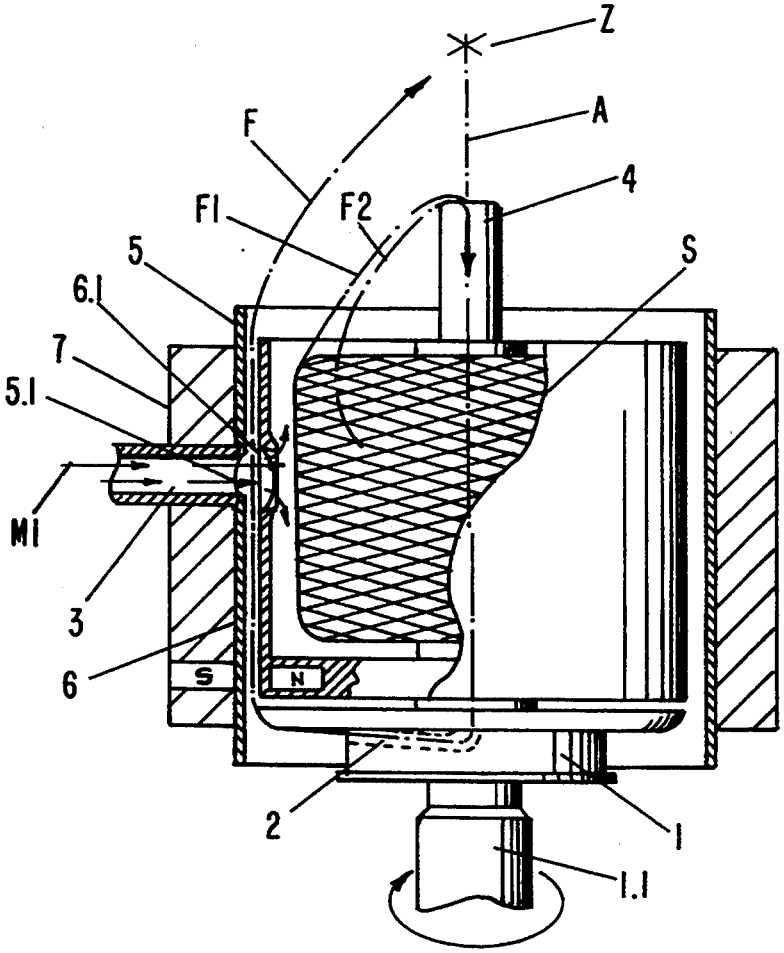
FIG. 1 shows a part-sectional, part-elevated view of a two-for-one twister with a first embodiment of a device for guiding a flowable medium into the spindle.

The spindle for manufacturing yarns according to the present invention is primarily characterized by:

A spindle rotor with a central axis;

A fiber guide duct extending substantially from the central axis radially outwardly for guiding a fiber radially outwardly, wherein the fiber, after exiting the fiber guide duct, is guided under formation of a fiber balloon to a centering point that is located on an extension of the central axis of the spindle rotor; and At least one inlet line extending substantially radially to the fiber balloon for introducing a flowable medium into a space limited by the fiber balloon.

In the context of the present invention, "yarn" is used in the sense commonly used in the textile industry, i.e., yarn includes spun yarns as well as filament yarn, thread, twine, etc.

Preferably, the spindle is a twisting spindle, further comprising a balloon limiter having for each inlet line a radial outlet opening. The inlet line is connected to the radial outlet opening.

Advantageously, the twisting spindle is a two-for-one twister, further comprising a hollow spindle shaft with a lower and an upper end. The hollow spindle shaft extends with the lower end into the fiber guide duct. At the upper end fibers to be twisted are introduced.

Expediently, the spindle is a direct cabling spindle. It further comprises a hollow spindle shaft. The spindle rotor has an axial extension. The hollow spindle shaft extends axially through the axial extension of the spindle rotor and opens into the fiber guide duct for guiding the fiber into the fiber guide duct. A second fiber is substantially axially fed from the space limited by the fiber balloon to the centering point for cabling with the fiber existing from the fiber guide duct.

In another preferred embodiment of the present invention, the spindle further comprises a fiber guide tube with a first and a second end. A first end is connected to the spindle rotor so that the fiber guide tube rotates with the spindle rotor. A second end extends to the centering point for guiding the fiber radially exiting from the fiber guide duct to the centering point.

In a further embodiment of the present invention the spindle further comprises a support with a protective pot wherein the protective pot has an inlet opening opposite a radial outlet opening of each inlet line.

Advantageously, the inlet opening has a diameter that is greater by a predetermined amount than the oppositely arranged radial outlet opening of the inlet line.

Preferably, the inlet opening is funnel-shaped radially inwardly. Expediently, two of the inlet lines are provided. Two inlet lines are positioned preferably diametrically opposite one another.

Advantageously, each inlet line has two branch lines extending toward the space limited by the fiber balloon. The branch lines are spaced from one another in a circumferential direction of the spindle. Opening and closing of the two branch lines are controlled as a function of a rotational speed of the spindle rotor.

The present invention is based on the surprising discovery that it is possible to introduce a flowable medium in the radial direction into the space limited by the fiber balloon through this fiber balloon. It is possible to guide the medium directly through the balloon that is either formed (described) by the fiber or by a thin rotating fiber guide tube. A fiber balloon has been proven to be surprisingly stable with respect to disturbances caused by the multi-phase medium stream. When however a contact between the rotating fiber and the flowable medium to be introduced should be prevented, the introduction of the medium can be controlled by switching on and switching off or switching between two inlet lines that are positioned at different locations of the fiber balloon such that no contact between the stream of the medium and the rotating fiber occurs.

It is also possible to guide the rotating fiber through a fiber guide tube that rotates with the spindle rotor so that a contact between the rotating fiber and the flowable medium prevented from the beginning.

DESCRIPTION OF PREFERRED EMBODIMENTS

The present invention will now be described in detail with the aid of several specific embodiments utilizing FIGS. 1 through 8.

Figure 2:
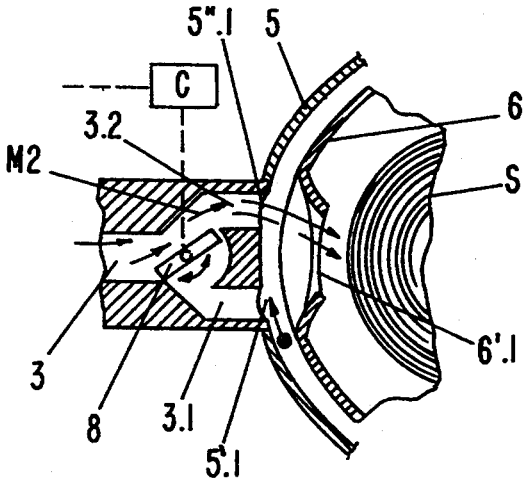
FIG. 2 shows a horizontal part-sectional view of a variant of the embodiment of FIG. 1 in the area of the device for introducing the flowable medium.
Figure 3:
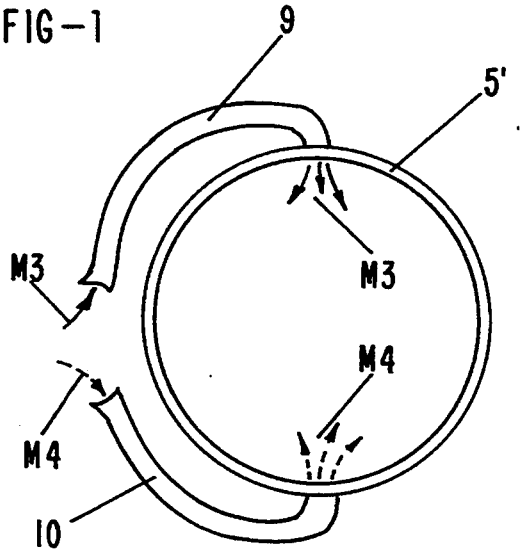
FIG. 3 shows a schematic view from the top of a further variant of the embodiment of FIG. 1.

FIGS. 1 through 3 represent only those parts of a two-for-one twister that are important for the following description of the invention. In FIG. 1 the spindle rotor 1 which is driven by the axial extension 1.1 is shown which has a fiber guide duct 2 that begins in the vicinity of the spindle axis A and extends radially outwardly. Also shown is a bobbin support with a protective pot 6 arranged above the spindle rotor 1 in which a non-twisted fiber supply, for example, a bobbin S as represented in FIG. 1, is introduced. The bobbin support with protective pot 6 is placed onto non-represented bearings on the spindle rotor 1 and is fixed against rotation with permanent magnets S/N. The bobbin support with protective pot 6 is surrounded by a balloon limiter 5. The fibers F1 and F2 removed from the bobbin S are guided through the fiber feed tube 4 along the spindle axis A to the center of the spindle rotor, and the fiber F exiting from the fiber guide duct 2 is guided in the space between the bobbin support with protective pot 6 and the balloon limiter 5 to the centering point Z which is in the form of a narrow fiber guide eyelet so that in the area between the bobbin support with protective pot 6 and the balloon limiter 5 a fiber balloon is formed in operation.

An inlet line 3 that is guided from a radially outer position in direction toward the spindle through a holder 7 ends in a radial outlet opening 5.1 of the balloon limiter 5. The outlet opening 5.1 is opposite an inlet opening 6.1 in the mantle of the protective pot 6. This inlet opening 6.1 has a slightly greater diameter than the outlet opening 5.1 and is funnel-shaped radially inwardly in order to provide favorable flow conditions for the flowable medium M1 introduced through the inlet line 3.

In the simplest embodiment represented in FIG. 1 the medium flows through a single inlet line 3, penetrates between the openings 5.1 and 6.1 the fiber balloon in order to be introduced into the interior of the protective pot 6. In this manner, the medium is in contact with the rotating fiber of the fiber balloon. If it is desired to prevent such a contact, it is possible to introduce the medium M1 in a discontinuous manner in a cycled operation or it is possible, when an uninterrupted introduction is required or desired, to modify the device represented in FIG. 1 in the manner represented in FIGS. 2 or 3.

In FIG. 2 identical elements of the device have the same reference numerals as in FIG. 1.

The inlet line 3 which is guided through the holder 7 is divided into two branch lines 3.1 and 3.2 in its end section which at a predetermined distance in the circumferential direction open with outlet openings 5.'1, respectively, 5."1 into the space delivered by the inner balloon limiter 5. Opposite the outlet openings 5.'1 and 5."1 an inlet opening 6.'1 in the mantle of the bobbin support with protective pot 6 is provided that is funnel-shaped radially inwardly and has a diameter selected such that the stream exiting from the outlet opening 5.'1 as well as from the outlet opening 5."1 is guided through the inlet opening 6.'1 into the interior of the bobbin support with protective pot 6. At the branch location of the line 3 a control flap 8 is provided that can be switched with a control device C so that alternatingly the branch line 3.1 or the branch line 3.2 can be selected for allowing passage of the stream of flowable medium therethrough. The control flap 8 is controlled such that during the movement of the fiber F in the fiber balloon, for example, the stream of flowable medium M2 is first guided through the branch line 3.2 until the fiber F has passed the exit opening 5.'1 of the branch line 3.1. At this moment the control flap 8 is switched so that the stream of medium flows through the branch line 3.1. (This is not represented in the drawings.) In this manner, the flowable medium can be guided with the aid of the suitably controlled control flap 8 such that the fiber F of the fiber balloon in the area of the outlet openings 5.'1 and 5."1 does not hit the fiber F. Of course, instead of the control flap 8 it is also possible to use a rotary valve which will be described in the following.

In the embodiment according to FIG. 2 the two branch lines are spaced apart at a relatively small distance in the circumferential direction. However, it may be expedient to increase this distance. Such an embodiment is shown in FIG. 3. For reasons of simplification in FIG. 3 only the balloon limiter 5' is shown of the entire spindle. The treatment medium M3, respectively, M4 is guided via two branch lines 9 and 10, which are arranged diametrically opposite one another, to be introduced into the protective pot, not represented, through the non-represented fiber balloon. The control of the non-represented distributing device may be performed such that upon approach and passing of the fiber at each of the two outlet openings the airstream flow is interrupted, respectively. It should be noted that the two branch lines 9 and 10 must not be branched off of a common inlet line. It is also possible to introduce different media M3, respectively, M4 via non-represented separate inlet lines via the lines 9 and 10.

The device for introducing a flowable medium represented in FIGS. 1 to 3, of course, can not only be used with a two-for-one twister but also in an analogous manner for a direct cabling spindle. This will be explained in the following with the aid of FIG. 7. The direct cabling spindle represented in FIG. 7 has a spindle rotor 31 which is driven via an axial extension 31.1 of the spindle and has a fiber guide duct 32. A first fiber F7 is guided from the exterior with a non-represented feed device A in the axial direction into the spindle and is deflected in the fiber guide duct 32 in the radial direction in which it exits from the spindle rotor 31. Above the spindle rotor 31 a bobbin support with protective pot 36 is arranged in which a not yet twisted yarn supply, for example, in the form of a feed bobbin S is inserted. The thread F7 exiting from the spindle rotor 31 in the space between the bobbin support with protective pot 36 and the balloon limiter 35 is guided to the centering point so that in the area between the bobbin support with the protective pot 36 and the balloon limiter 35 a fiber balloon is formed during operation. The fiber F6 withdrawn from the bobbin S in the interior of the bobbin support with protective pot 36 is guided via a fiber braking device 38 that is fixedly connected to the bobbin support at the upper portion 36.2 of the bobbin support with protective pot 36 to the centering point Z whereby the first fiber F7 is wound about the removed fiber F6.

The flowable medium M8 is guided via line 33 radially inwardly through the holder 37. The line 33 ends in an outlet opening of the balloon limiter 35 which is positioned opposite an inlet opening 36.1 in the mantle of the protective pot 36. The inlet opening 36.1 is funnel-shaped in the radially inner direction. The feed of the medium M8 is carried out in the same manner as explained supra in connection with FIG. 1.

In the following a further device for introducing a flowable medium into a direct cabling spindle will be explained with the aid of FIGS. 4 and 5.

Figure 4:
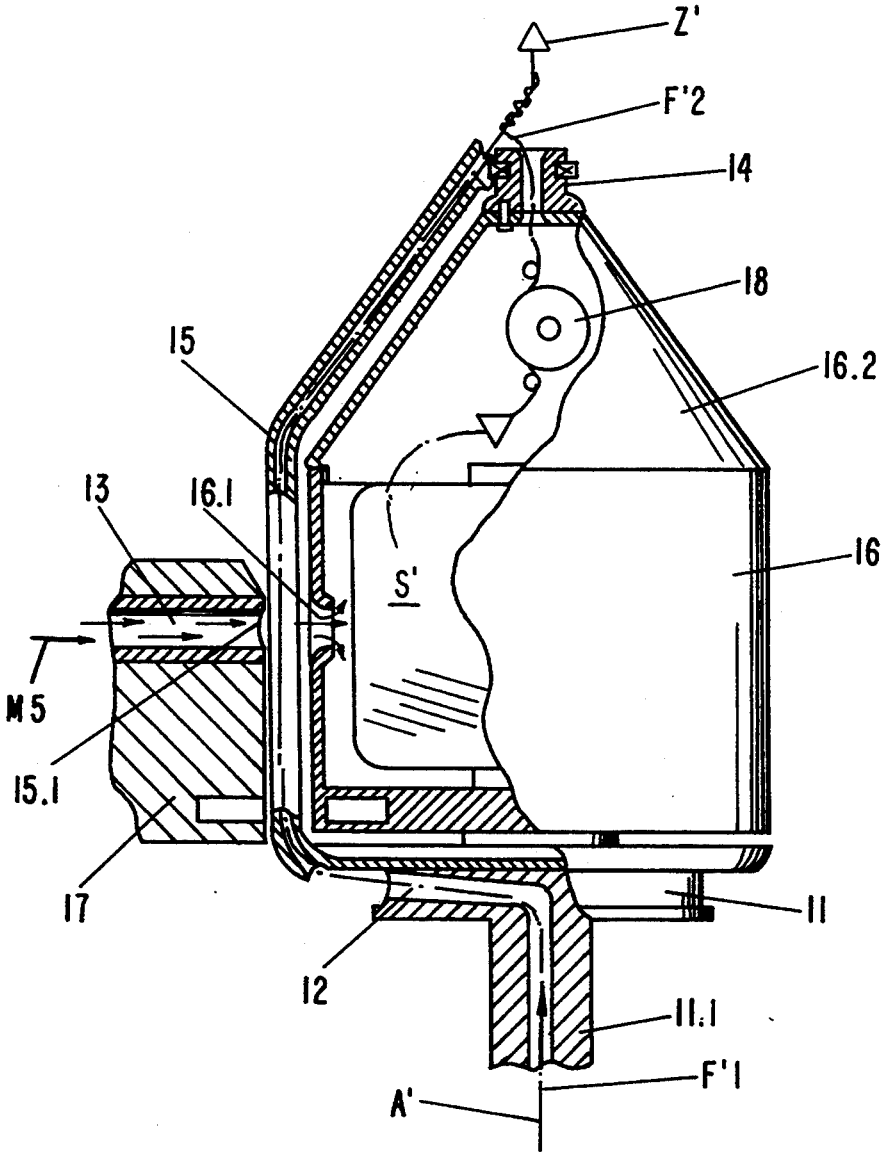
FIG. 4 shows a direct cabling spindle in part-sectional, part-elevated view with another embodiment of a device for introducing a flowable medium.

The direct cabling spindle represented in FIG. 4 has a spindle rotor 11 that is driven by an axial extension 11.1 of the spindle and which has a fiber guide duct 12 through which from an external non-represented feeding device a first fiber F'1 is introduced in the axial direction and deflected in the fiber guide duct 12 in the radial direction in which it exits from the spindle rotor 11. Connected to the spindle rotor 11 is a bobbin support with protective pot 16 into which a non-twisted partial supply bobbin S' is inserted. In the represented case the fiber F'1 does not form a free fiber balloon but is introduced into a fiber guide tube 15 fixedly connected to the spindle rotor 11. The fiber is guided within the fiber guide tube 15 about the bobbin support with protective pot 16 to a centering point Z' located above the spindle on the spindle axis A'.

The second fiber F'2 removed from the supply bobbin S' in the interior of the bobbin support with protective pot 16 runs via the fiber braking device 18 that is fixedly connected to the bobbin support with protective pot 16 at the upper portion 16.2 thereof to a centering eyelet 14 at the tip of the protective pot 16 and from there to the centering point Z' whereby the first fiber F'1 is wound about the second fiber F'2.

The fiber guide tube 15 is supported with a rotational bearing at the centering eyelet 14. During operation the first fiber F'1 is guided with the rotating fiber guide tube 15 about the bobbin support carrier with protective pot 16. At a predetermined position outside of the rotational path of the fiber guide tube 15 a holder 17 is arranged through which a line 13 is guided radially toward the spindle. The line 13 opens into an outlet opening 15.1 opposite to which an inlet opening 16.1 in the mantle of the bobbin support with protective pot 16 is positioned, as described in the other embodiments. The inlet opening 16.1 is funnel-shaped towards the interior in order to provide for favorable inflow conditions. Through the line 13 a flowable medium M5 is guided which exits through the outlet opening 15.1 and enters through the inlet opening 16.1 into the interior of the bobbin support with protective pot 16. In the embodiment represented in FIG. 3 with only one line 13, the flow M5 of the medium hits the rotating fiber guide tube 15 when the fiber guide tube 15 passes the outlet opening 15.1. When it is desired to prevent the flowable medium from hitting the fiber guide tube 15, the device may be embodied as is represented in FIG. 5 in which same components are indicated with same reference numerals. In the embodiment according to FIG. 5 the line 13 is divided into two branch lines 13.1 and 13.2 that open at a predetermined distance in the circumferential direction into outlet openings 15.'1 and 15."1. Opposite the two outlet openings 15.'1 and 15."1, an inlet opening 16.'1 in the mantle of the bobbin support with protective pot 16 is located which is embodied such that the medium flowing through the branch line 13.1 as well as through the branch line 13.2 can enter the bobbin support with protective pot 16 through the inlet opening 16.'1. With a schematically represented control device C1 the introduction of the medium M6 can be controlled such that during passing of the fiber guide tube 15 along the outlet opening 15.'1 the inflow through the branch line 13.2 takes place while, for example, after passage of the outlet opening the flow of the medium can again be guided through the branch line 13.1. With a suitable control of the flow it is thus possible that with a continuous flow of medium the fiber guide tube 15 is not hit by the flowable medium upon passing the outlet openings.

Of course, it is also possible in this embodiment, in analogy to the embodiment of FIG. 3, to provide diametrically oppositely arranged branch lines.

Figure 5:
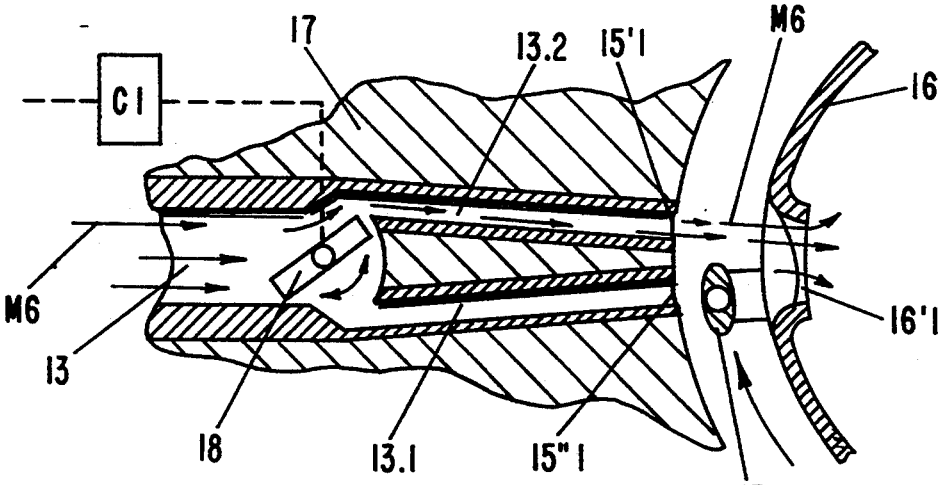
FIG. 5 shows in a horizontal part-sectional view a variant of the embodiment of FIG. 4 in the area of the device for introducing the flowable medium.
Figure 6:
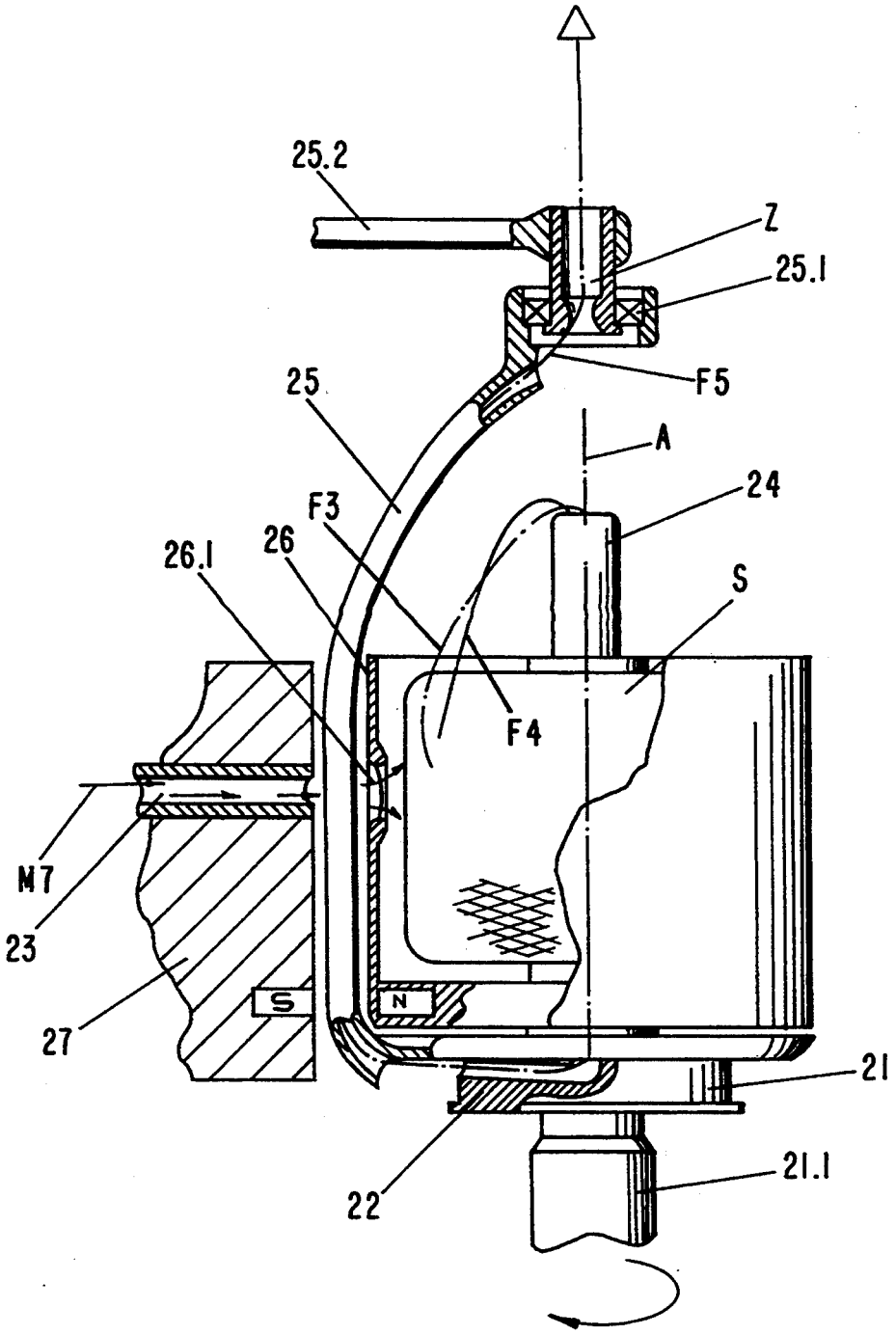
FIG. 6 shows in a representation in analogy to FIG. 1 a two-for-one twisting spindle with an embodiment of a device for introducing a flowable medium in analogy to FIG. 4.
Figure 7:
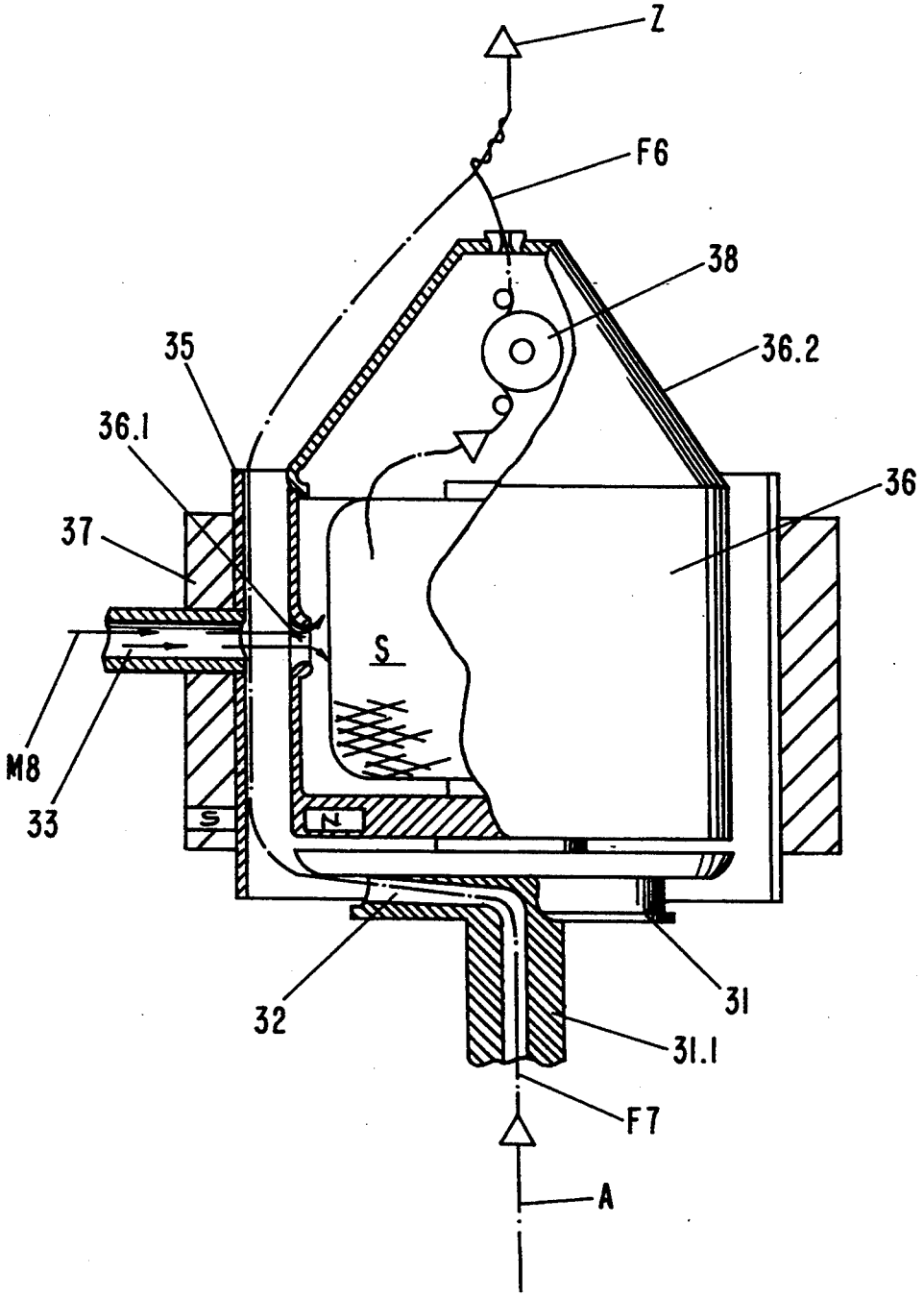
FIG. 7 shows in a representation analogous to FIG. 4 a direct cabling spindle with an embodiment for a device for introducing the flowable medium in analogy to FIG. 1.

The device described with the aid of FIGS. 4 and 5 for introducing a flowable medium may also be used in connection with a two-for-one twister. This is represented in FIG. 6. The two-for-one twister has a spindle rotor 21 which is driven by an axial extension 21.1 and which has a radially outwardly oriented fiber guide duct 22. Above the spindle rotor 21 a bobbin support with protective pot 26 is arranged into which a supply bobbin S is inserted. The fibers F3 and F4 removed from the yarn supply of the bobbin S are guided through the feed tube 24 along the spindle axis to the center of the rotor. The fiber F5 exiting from the fiber guide duct 22 in this embodiment does not form a free fiber balloon but in analogy to the embodiment according to FIG. 4, is received in a fiber guide tube 25 that is fixedly connected to the spindle rotor 21. The fiber is guided within the fiber guide tube 25 about the bobbin support with protective pot 26 and is guided to a centering point Z located on the spindle axis. The centering point is embodied as a centering eyelet 25.1 and is connected via a support 25.2 to the non-represented machine frame. The upper end of the fiber guide tube 25 is supported with a rotary bearing at the centering eyelet 25.1. At a predetermined position outside of the rotational path of the fiber guide tube 25 a support 27 is provided through which a line 23 extends in a radial direction towards the spindle for guiding the flowable medium M7. The outlet opening of the inlet line 23 is oppositely arranged to an inlet opening 26.1 in the mantle of the bobbin support with protective pot 26. This inlet opening 26.1 is funnel-shaped in the radially inward direction. The function of this device corresponds to the function of the device according to FIG. 4.

Figure 8:
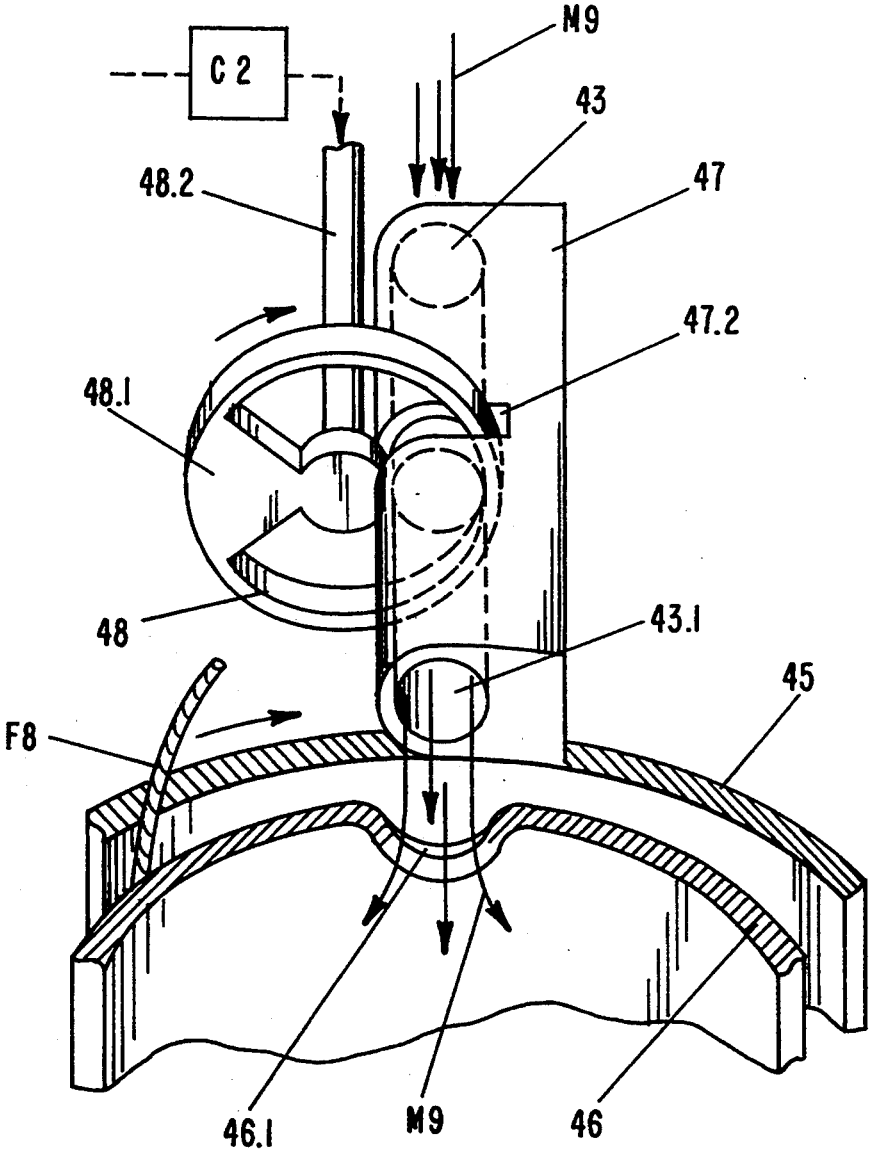
FIG. 8 shows a perspective partial view of a further variant of the embodiment of FIGS. 1 or 7 in the area of the device for introducing the flowable medium.

In FIG. 8 a further embodiment of the device for introducing a flowable medium M9 is represented which serves to discontinuously introduce the medium in a cycled operation. This device, for example, can be used with the twister spindle of FIG. 1 or FIG. 7. The inlet line 43 which extends in the radial direction toward the spindle is provided in a holder 47 and opens into an outlet opening 43.1 in the balloon limiter 45. Opposite to the outlet opening 43.1 is positioned an inlet opening 46.1 in the aforedescribed manner within mantle of the protective pot 46. The fiber F8 which forms the fiber balloon is guided within the intermediate space between the balloon limiter 45 and the protective pot 46. The support 47 has a transverse slot 47.2 that penetrates the inlet line 43. An aperture plate 48 is positioned in the slot 47.2 and is arranged on a drive shaft 48.2 that is rotated by a drive and control device C2. As soon as the closed section 48.1 of the aperture plate 48 is positioned in the slot 47.2, the flow of the medium M9 through the inlet line 43 is interrupted for the length of time that it takes the section 48.1 to pass through the slot 47.2. Of course, in this manner it is also possible to control the flow of medium through branch lines, as shown in FIG. 2, such that the medium flows only into one branch line and in a different position through the other branch line.

The medium flow can be in the form of conditioned air, especially humidified air, oil mist-conditioning, paraffin particle-containing, or smoke-containing air etc. or optionally other multi-phase treatment media in order to improve or optimize the fiber or yarn properties in a particular manner. It is also possible to introduce dissolved fiber material into the stream of air. The inventive solution is also suitable for spindles without protective pot.

The present invention is, of course, in no way restricted to the specific disclosure of the specification and drawings, but also encompasses any modifications within the scope of the appended claims.

What we claim is:

1. A spindle for manufacturing yarns said spindle comprising:

a spindle rotor with a central axis;

a fiber guide duct extending substantially from said central axis radially outwardly for guiding a fiber radially outwardly, wherein the fiber, after exiting said fiber guide duct, is guided under formation of a fiber balloon to a centering point that is located on an extension of said central axis A of said spindle rotor;

at least one inlet line, extending substantially radially to the fiber balloon, for introducing a flowable medium into a space limited by the fiber balloon; and a bobbin support with a protective pot, wherein said protective pot has an inlet opening opposite a radial outlet opening of each said inlet line.

2. A spindle according to claim 1, wherein said spindle is a twisting spindle, further comprising a balloon limiter having for each said inlet line a radial outlet opening, said inlet line connected to said radial outlet opening.

3. A spindle according to claim 2, wherein said twisting spindle is a two-for-one twister, further comprising a hollow spindle shaft with a lower and an upper end, said hollow spindle shaft extending with said lower end into said fiber guide duct, wherein the fibers to be twisted are introduced at said upper end.

4. A spindle according to claim 1, wherein said inlet opening has a diameter that is greater by a predetermined amount than said oppositely arranged outlet of said inlet line.

5. A spindle according to claim 4, wherein said inlet opening is funnel-shaped radially inwardly.

6. A spindle according to claim 1, wherein two of said inlet lines are provided.

7. A spindle according to claim 6, wherein said two inlet lines are positioned diametrically opposite one another.

8. A spindle according to claim 1, wherein said spindle is a direct cabling spindle, further comprising a hollow spindle shaft, wherein said spindle rotor has an axial extension, with said hollow spindle shaft extending axially through said axial extension and opening into said fiber guide duct for guiding the fiber into the fiber guide duct, wherein a second fiber is substantially axially fed from said space limited by the fiber balloon to said centering point for cabling with the fiber exiting from said fiber guide duct.

9. A spindle according to claim 1, further comprising a fiber guide tube with a first and a second end, wherein a first end is connected to said spindle rotor so that said fiber guide tube rotates with said spindle rotor and wherein a second end extends to said centering point, for guiding the fiber radially exiting from said fiber guide duct to said centering point.

10. A spindle according to claim 1, wherein each said inlet line has two branch lines extending toward said space limited by the fiber balloon, said branch lines spaced from one another in a circumferential direction of said spindle, wherein opening and closing of said two branch lines are controlled as a function of a rotational speed of said spindle rotor.

* * * * *